US007048815B2

(12) United States Patent
Senkov et al.

(10) Patent No.: US 7,048,815 B2
(45) Date of Patent: May 23, 2006

(54) METHOD OF MAKING A HIGH STRENGTH ALUMINUM ALLOY COMPOSITION

(75) Inventors: Oleg N. Senkov, Fairborn, OH (US); Svetlana V. Senkova, Fairborn, OH (US); Madan G. Mendiratta, Beavercreek, OH (US); Daniel B. Miracle, Bellbrook, OH (US)

(73) Assignee: UES, Inc., Dayton, OH (US)

( * ) Notice: Subject to any disclaimer, the term of this patent is extended or adjusted under 35 U.S.C. 154(b) by 224 days.

(21) Appl. No.: 10/291,201

(22) Filed: Nov. 8, 2002

(65) Prior Publication Data

US 2004/0089382 A1 May 13, 2004

(51) Int. Cl.
*C22F 1/53* (2006.01)

(52) U.S. Cl. ..... 148/549; 148/694; 148/701

(58) Field of Classification Search ..... 148/417, 148/694, 698, 701; 420/532, 553
See application file for complete search history.

(56) References Cited

U.S. PATENT DOCUMENTS

| | | | | |
|---|---|---|---|---|
| 3,984,260 | A | 10/1976 | Watts | |
| 4,713,216 | A | 12/1987 | Higashi et al. | |
| 4,869,870 | A | 9/1989 | Rioja et al. | |
| 4,927,470 | A | 5/1990 | Cho | |
| 4,946,517 | A | 8/1990 | Cho | |
| 4,954,188 | A * | 9/1990 | Ponchel et al. | 148/694 |
| 4,988,394 | A | 1/1991 | Cho | |
| 5,055,257 | A * | 10/1991 | Chakrabarti et al. | 148/564 |
| 5,061,327 | A | 10/1991 | Denzer et al. | |
| 5,066,342 | A | 11/1991 | Rioja et al. | |
| 5,108,519 | A | 4/1992 | Armanie et al. | |
| 5,135,713 | A | 8/1992 | Rioja et al. | |
| 5,211,910 | A | 5/1993 | Pickens et al. | |
| 5,277,719 | A * | 1/1994 | Kuhlman et al. | 148/694 |
| 5,292,386 | A * | 3/1994 | Schelb et al. | 148/691 |
| 5,462,712 | A | 10/1995 | Langan et al. | |
| 5,512,241 | A | 4/1996 | Kramer et al. | |
| 5,571,347 | A * | 11/1996 | Bergsma | 148/550 |
| 5,597,529 | A | 1/1997 | Tack | |
| 5,865,914 | A | 2/1999 | Karabin et al. | |
| 6,027,582 | A | 2/2000 | Shahani et al. | |
| 6,048,415 | A | 4/2000 | Nakai et al. | |
| 6,056,835 | A | 5/2000 | Miyake et al. | |
| 6,139,653 | A | 10/2000 | Fernandes et al. | |
| 6,248,453 | B1 | 6/2001 | Watson | |
| 6,315,842 | B1 | 11/2001 | Shahani et al. | |
| 6,331,218 | B1 | 12/2001 | Inoue et al. | |
| 6,368,427 | B1 | 4/2002 | Sigworth | |
| 6,627,012 | B1 * | 9/2003 | Tack et al. | 148/690 |
| 2004/0094249 | A1 * | 5/2004 | Uchida et al. | 148/693 |

OTHER PUBLICATIONS

"Aluminum standards and data 2003", Aluminum Association, Inc. 2003, p. 5-7.*

* cited by examiner

*Primary Examiner*—George Wyszomierski
*Assistant Examiner*—Janelle Morillo
(74) *Attorney, Agent, or Firm*—Dinsmore & Shohl LLP

(57) ABSTRACT

The present invention provides a method of making a high strength aluminum alloy composition. The alloy composition exhibits high tensile strength at ambient temperatures and cryogenic temperatures. The alloy composition can exhibit high tensile strength while maintaining a high elongation in ambient temperatures and cryogenic temperatures.

59 Claims, 5 Drawing Sheets

METHOD OF MAKING A HIGH STRENGTH ALUMINUM ALLOY COMPOSITION

STATEMENT REGARDING FEDERALLY SPONSORED RESEARCH OR DEVELOPMENT

This invention was made with government support under Contract No. F04611-01-C0030 awarded by the Department of the Air Force. The Government has certain rights in this invention.

CROSS-REFERENCE TO RELATED APPLICATIONS

This application is related to U.S. application Ser. No. 10/291,184, filed Nov. 8, 2002.

BACKGROUND

The present invention relates generally to aluminum alloy compositions, and more particularly to method of making a high strength aluminum alloy composition.

There is a continuing drive in the art to increase the strength of aluminum alloy compositions. The present inventors have recognized that novel combination of chemistry, mechanical processing and heat treatment of the aluminum alloy compositions play an important role in improving the strength and ductility and that there is a need for aluminum alloy compositions that possess high strength and are suitable for use in various applications that require metallic materials with advanced properties.

There is also a continuing drive in the art to reduce process cost. The present inventors have also recognized that aluminum alloy compositions can play an important role in containing or reducing these costs.

SUMMARY OF THE INVENTION

These needs are met by the present invention which provides a high strength aluminum alloy composition and applications of the high strength aluminum alloy composition.

In one embodiment of the present invention an aluminum alloy composition is provided comprising between about 6.0% by wt. and about 12.0% by wt. of zinc, between about 2.0% by wt. and about 3.5% by wt. of magnesium, between about 0.01% by wt. and about 0.5% by wt. of scandium, between about 0.05% by wt. and about 0.20% by wt. of zirconium, between about 0.5% by wt. and about 3.0% by wt. of copper, between about 0.10% by wt. and about 0.45% by wt. of manganese, between about 0.02% by wt. and about 0.35% by wt. of iron, between about 0.02% by wt. and about 0.20% by wt. of silicon, between about 0.00% by wt. and about 0.05% by wt. of titanium, between about 0.00% by wt. and about 0.25% by wt. of chromium, between about 0.00% by wt. and about 0.05% by wt. of vanadium, between about 0.00% by wt. and about 0.25% by wt. of hafnium, between about 0.00% by wt. and about 0.20% by wt. of cerium, between about 0.00% by wt. and about 0.20% by wt. of nickel, between about 0.00% by wt. and about 0.20% by wt. of silver, and aluminum. The aluminum alloy composition has a tensile strength of at least 650 MPa with an elongation of at least 7% at room temperature. The aluminum alloy composition has a tensile strength of at least 790 MPa with an elongation of at least 6% at a cryogenic temperature. The aluminum alloy composition has a tensile strength of at least 900 MPa at room temperature. The aluminum alloy composition has a tensile strength of at least 900 MPa at cryogenic temperature.

The present invention will be more fully understood from the following description of preferred embodiments of the invention taken together with the accompanying drawings. It is noted that the scope of the claims is defined by the recitations therein and not by the specific discussion of features and advantages set forth in the present description.

BRIEF DESCRIPTION OF THE DRAWINGS

The following detailed description of the embodiments of the present invention can be best understood when read in conjunction with the following drawings, where like structure is indicated with like reference numerals and in which.

DETAILED DESCRIPTION OF THE INVENTION

Figure 1:
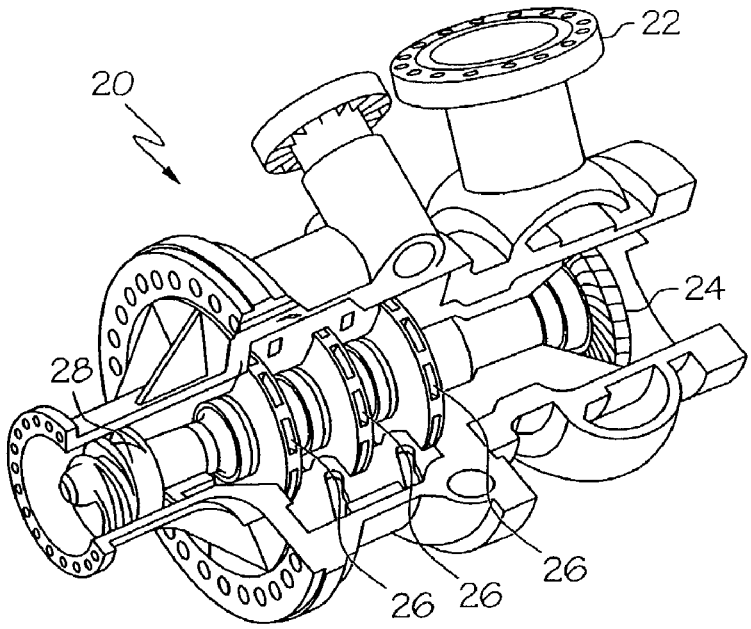
FIG. 1 is a cross-section of a cryogenic pump according to the present invention.

The aluminum alloy composition of the present invention generally comprises between about 6.0% by wt. to about 12.0% by wt. zinc, between about 2.0% by wt. to about 3.5% by wt. magnesium, between about 0.01% by wt. to about 0.5% by wt. scandium, between about 0.05% by wt. to about 0.20% by wt. zirconium, between about 0.5% by wt. to about 3.0% by wt. copper, between about 0.10% by wt. to about 0.45% by wt. manganese, between about 0.02% by wt. to about 0.35% by wt. iron, and between about 0.02% by wt. to about 0.20% by wt. silicon, and aluminum as the base material. The composition may also further include between about 0.00% by wt. to about 0.25% by wt. hafnium, between about 0.00% by wt. to about 0.2% by wt. cerium, between about 0.00% by wt. to about 0.2% by wt. nickel, between about 0.00% by wt. to about 0.2% by wt. silver, between about 0.00% by wt. to about 0.05% by wt. titanium, between about 0.00% by wt. to about 0.25% by wt. chromium, and between about 0.00% by wt. to about 0.05% by wt. vanadium. This composition exhibits a tensile strength of at least 650 MPa with an elongation of at least 7% at room temperature. The composition can exhibit a tensile strength of at least 790 MPa with an elongation of at least 6% at a cryogenic temperature. The composition can exhibit a tensile strength of at least 900 MPa at room temperature and at cryogenic temperature. This very high strength allows the aluminum alloy compositions to replace much more expensive titanium alloys in several room temperature and cryogenic applications. The cryogenic temperature is generally about the temperature of liquid nitrogen or (about −196° C.).

The aluminum alloy composition of the present invention exhibits high tensile strength at ambient temperatures and cryogenic temperatures. The high tensile strength can be achieved while maintaining a high elongation at ambient temperatures and cryogenic temperatures. By cryogenic temperatures, we mean temperatures that are well below room temperature, typically below −50° C., often as low as, or lower than the temperature of liquid nitrogen (−196° C.) and can be as low as the temperature of liquid helium (−269° C.).

In one embodiment of the present invention, the aluminum alloy composition generally contains between about 6.5% by wt. to about 8.0% by wt. zinc, between about 2.0% by wt. to about 2.35% by wt. magnesium, between about 1.50% by wt. to about 1.65% by wt. copper, between about 0.15% by wt. to about 0.3% by wt. manganese, between about 0.10% by wt. to about 0.20% by wt. zirconium, between about 0.00% by wt. to about 0.1% by wt. hafnium, between about 0.085% by wt. to about 0.10% by wt. iron, and between about 0.08% by wt. to about 0.09% by wt. silicon, and aluminum as a base material.

In one embodiment of the present invention, the aluminum alloy composition contains about 7.14% by wt. zinc, about 2.30% by wt. magnesium, about 1.61% by wt. copper, about 0.27% by wt. manganese, about 0.17% by wt. zirconium, about 0.05% by wt. hafnium, about 0.12% by wt. iron, and about 0.09% by wt. silicon, and aluminum as a base material. This aluminum alloy composition exhibits a tensile strength of between about 810 MPa to about 905 MPa and an elongation between about 6.5% to about 11.0% at the cryogenic temperature, wherein the cryogenic temperature is about the temperature of liquid nitrogen (−196° C.). At room temperature, this aluminum alloy composition exhibits a tensile strength between about 677 MPa to about 697 MPa and an elongation between about 10% to about 14%.

In another embodiment of the present invention, the aluminum alloy composition contains about 7.17% by wt. zinc, about 2.2% by wt. magnesium, about 1.58% by wt. copper, about 0.30% by wt. manganese, about 0.18% by wt. zirconium, about 0.18% by wt. scandium, about 0.13% by wt. iron, and about 0.088% by wt. silicon, and aluminum as a base material. This aluminum alloy composition exhibits a tensile strength between about 785 MPa to about 946 MPa and an elongation between about 6.0% to about 11.5% at the cryogenic temperature, wherein the cryogenic temperature is the temperature of liquid nitrogen (about −196° C.). At room temperature, this aluminum alloy composition exhibits a tensile strength between about 690 MPa to about 710 MPa and an elongation between about 10% to about 17%.

In another embodiment of the present invention, the aluminum alloy composition contains about 7.11% by wt. zinc, about 2.14% by wt. magnesium, about 1.56% by wt. copper, about 0.25% by wt. manganese, about 0.17% by wt. zirconium, about 0.38% by wt. scandium, about 0.094% by wt. iron, and about 0.088% by wt. silicon, and aluminum as a base material. This aluminum alloy composition exhibits a tensile strength between about 760 MPa and about 926 MPa and an elongation between about 6.0% to about 11.5% at the cryogenic temperature, wherein the cryogenic temperature is about the temperature of liquid nitrogen (about −196° C.). At room temperature, this aluminum alloy composition exhibits a tensile strength between about 670 MPa to about 690 MPa and an elongation between about 8% to about 12%.

In another embodiment of the present invention, the aluminum alloy composition contains about 7.05% by wt. zinc, about 2.35% by wt. magnesium, about 1.55% by wt. copper, about 0.27% by wt. manganese, about 0.14% by wt. zirconium, about 0.49% by wt. scandium, about 0.095% by wt. iron, and about 0.082% by wt. silicon, and aluminum as a base material. This aluminum alloy composition exhibits a tensile strength between about 847 MPa to about 907 MPa and an elongation between about 6.0% to about 7.0% at the cryogenic temperature, wherein the cryogenic temperature is about the temperature of liquid nitrogen (about −196° C.).

In another embodiment of the present invention, the aluminum alloy composition contains between about 10.0% by wt. to about 12.0% by wt. zinc, between about 2.5% by wt. to about 3.5% by wt. magnesium, between about 1.0% by wt. to about 1.5% by wt. copper, between about 0.35% by wt. to about 0.40% by wt. manganese, between about 0.12% by wt. to about 0.15% by wt. zirconium, and between about 0.45% by wt. to about 0.5% by wt. scandium, between about 0.07% by wt. to about 0.15% by wt. silicon, and between about 0.07% by wt. to about 0.15% by wt. iron, and aluminum.

In another embodiment of the present invention, the aluminum alloy composition contains about 10.3% by wt. zinc, about 2.7% by wt. magnesium, about 1.3% by wt. copper, about 0.38% by wt. manganese, about 0.15% by wt. zirconium, about 0.49% by wt. scandium, about 0.08% by wt. silicon, and about 0.12% by wt. iron, and aluminum as a base material. This aluminum alloy composition exhibits a tensile strength of about 780 MPa with an elongation of 7% at room temperature and a tensile strength of about 1015 MPa at the cryogenic temperature, wherein the cryogenic temperature is about the temperature of liquid nitrogen (about −196° C.).

In another embodiment of the present invention, the aluminum alloy containing about 12.0% by wt. zinc, about 3.3% by wt. magnesium, about 1.2% by wt. copper, about 0.38% by wt. manganese, about 0.13% by wt. zirconium, and about 0.49% by wt. scandium, and aluminum as a base material. At the cryogenic temperature, this aluminum alloy composition exhibits a tensile strength of about 810 MPa with elongation of about 8.5% after over-aging at 200° C. After being treated to a maximum hardness (T6 temper), the alloy composition exhibits a tensile strength of about 809 MPa. The cryogenic temperature is about the temperature of liquid nitrogen (about −196° C.).

In another embodiment of the present invention, the aluminum alloy composition contains between about 8.0% by wt. to about 10.0% by wt. zinc, between about 2.5% by wt. to about 3.5% by wt. magnesium, between about 2.0% by wt. to about 3.0% by wt. copper, between about 0.05% by wt. to about 0.15% by wt. chromium, between about 0.15% by wt. to about 0.20% by wt. cerium, between about 0.05% by wt. to about 0.20% by wt. nickel, between about 0.05% by wt. to about 0.1% by wt. vanadium, between about 0.1% by wt. to about 0.2% by wt. zirconium, between about 0.1% by wt. to about 0.4% by wt. scandium, between about 0.05% by wt. to about 0.15% by wt. iron, and between about 0.05% by wt. to about 0.15% by wt. silicon, and aluminum.

In another embodiment of the present invention, the aluminum alloy composition contains about 9.0% by wt. zinc, about 3.0% by wt. magnesium, about 2.6% by wt. copper, about 0.1% by wt. chromium, about 0.2% by wt. cerium, about 0.20% by wt. nickel, about 0.1% by wt. vanadium, about 0.2% by wt. zirconium, about 0.2% by wt. scandium, about 0.12% by wt. iron, and about 0.09% by wt. silicon, and aluminum as a base material. After T6 temper, this alloy composition exhibits tensile strength of about 780 MPa with elongation of about 14% at room temperature.

In another embodiment of the present invention, the aluminum alloy composition contains between about 8.0% by wt. to about 10.0% by wt. zinc, between about 2.0% by wt. to about 3.0% by wt. magnesium, between about 2.0% by wt. to about 3.0% by wt. copper, between about 0.15% by wt. to about 0.30% by wt. manganese, between about 0.05% by wt. to about 0.20% by wt. hafnium, between about 0.05% by wt. to about 0.15% by wt. zirconium, between about 0.1% by wt. to about 0.5% by wt. scandium, between about 0.05% by wt. to about 0.15% by wt. chromium, between about 0.05% by wt. to about 0.20% by wt. iron, between about 0.05% by wt. to about 0.15% by wt. silicon, between about 0.00% by wt. to about 0.05% by wt. nickel, between about 0.00% by wt. to about 0.05% by wt. titanium, between about 0.00% by wt. to about 0.05% by wt. vanadium, and aluminum.

In another embodiment of the present invention, the aluminum alloy composition comprises about 8.9% by wt. zinc, about 2.7% by wt. magnesium, about 2.4% by wt. copper, about 0.2% by wt. manganese, about 0.1% by wt. hafnium, about 0.1% by wt. zirconium, about 0.46% by wt. scandium, about 0.05% by wt. chromium, about 0.16% by wt. iron, about 0.07% by wt. silicon, less than 0.05% by wt. nickel, less than 0.05% by wt. titanium, less than 0.05% by wt. vanadium, and aluminum as a base material. After T6 temper, this alloy composition exhibits Vickers hardness of about 2100 MPa, tensile strength of about 810 MPa, and elongation of about 14% at room temperature and tensile strength of about 1010 MPa at the cryogenic temperature. The cryogenic temperature is about the temperature of liquid nitrogen (about −196° C.).

In another embodiment of the present invention, the aluminum alloy composition contains between about 8.0% by wt. to about 10.0% by wt. zinc, between about 2.0% by wt. to about 3.0% by wt. magnesium, between about 2.0% by wt. to about 3.0% by wt. copper, between about 0.15% by wt. to about 0.30% by wt. manganese, between about 0.05% by wt. to about 0.20% by wt. silver, between about 0.05% by wt. to about 0.15% by wt. zirconium, between about 0.1% by wt. to about 0.5% by wt. scandium, between about 0.05% by wt. to about 0.20% by wt. iron, between about 0.05% by wt. to about 0.15% by wt. silicon, and aluminum.

In another embodiment of the present invention, the aluminum alloy composition contains about 8.5% by wt. zinc, about 2.6% by wt. magnesium, about 2.2% by wt. copper, about 0.2% by wt. manganese, about 0.1% by wt. silver, about 0.1% by wt. zirconium, about 0.4% by wt. scandium, about 0.15% by wt. iron, about 0.10% by wt. silicon, and aluminum as a base material. After T6 temper, this alloy composition exhibits Vickers hardness of about 2160 MPa, tensile strength of about 790 MPa, and elongation of about 12% at room temperature. The cryogenic temperature, the alloy composition exhibits a tensile strength of about 985 MPa and an elongation of about 6.5%. The cryogenic temperature is about the temperature of liquid nitrogen (about −196° C.).

The method of the making the high strength aluminum alloy composition will now be described. The method of making the high strength aluminum alloy composition includes selecting alloying elements in the amounts described above. The alloying elements are melted together such that all elements are in the liquid solution and no solid intermetallic particles are present. The melt temperature is above 700° C. and more specifically is between about 750° C. to about 800° C. The melt should be protected from reaction with air by using a protective atmosphere, such as an inert atmosphere, or using fluxes. Elemental material or master alloys can be used to produce the alloy composition.

Once the alloy is completely molten and well stirred, casting is performed by any suitable method that provides a cooling rate that is typically not less than about 40° C./sec during solidification and cooling to a temperature of about 300° C. If the temperature of the alloy while being casted is below 300° C., then cooling can occur at any rate. Next, the alloy may be hot-worked by any suitable method, such as extrusion, rolling, or forging, to break up the dendritic structure of cast material. Generally, the hot-working is conducted at a temperature between about 350° C. to about 450° C. The true strain is about 1 or higher while the hot-working is conducted on the alloy.

The next step may be to heat treat the aluminum alloy composition. The heat treatment consists of solution annealing, fast quenching to room temperature, and aging. The temperature for solution annealing is selected such that it provides most alloying elements to go in solid solution. The temperature should not exceed the eutectic temperature above which an eutectic component of the alloy melts. Typically solution annealing occurs at a temperature between about 430° C. to about 515° C., and more specifically between about 460° C. and about 480° C. The solution annealing typically occurs for an amount of time of about 1 hour. The aluminum alloy composition is then quenched after this annealing step. The quenching is typically conducted at a rate that is high enough to prevent precipitation of the elements from the solid solution. Typically, water or oil quenching is used.

Aging allows for the properties of the aluminum alloy composition to change over time at room temperature or at elevated temperatures. During aging the elements, which are in supersaturated solid solution after solution annealing and quenching, precipitate in very fine clusters (or intermetallic particles) that may increase strength of the alloy considerably. It is to be appreciated that the length of time and the temperature of the aging of the aluminum alloy composition may vary depending on the mechanical properties desired for the aluminum alloy composition. Typically, the aluminum alloy composition is aged at a temperature between about 110° C. to about 160° C. for an amount of time between 1 hour and 24 hours.

For aluminum alloy compositions that have a zinc content less than 8 wt. %, generally a two-step aging is conducted. Thus, the aluminum alloy composition is aged, as described in the paragraph above, at a temperature between about 110° C. to about 130° C. for an amount of time between 2 hours and 48 hours. Then, the aluminum alloy composition can be aged a second time at a second higher aging temperature which is typically up to about 160° C. for an amount of time between 0.5 hours and 6 hours. If the two-step aging process is used, typically the first aging temperature is about 120° C. and the second aging temperature is about 150° C. The two-step aging process can increase the strength of the aluminum alloy composition. However, the two-step aging process is not performed on all aluminum alloy compositions for the desired strength to be obtained. If the two-step aging process is not used, then the first aging temperature is between about 120° C. and about 150° C. and the aging time is between about 6 hours and 24 hours.

For an alloy composition with a zinc content of 8 wt. % or higher, the second aging is typically conducted at a higher temperature, generally between about 160° C. to about 200° C., for a period of time not exceeding 1 hour. This second aging is performed to increase ductility.

An additional annealing of the aluminum alloy composition may be conducted, thereby exposing the aluminum alloy composition to a two-step annealing process. The additional annealing occurs at a temperature between about 250° C. and about 370° C. for an amount of time between about 0.5 hours and about 6 hours. This additional annealing occurs prior to the hot-working step described above. Therefore, if the two-step annealing process is used, the aluminum alloy composition is annealed at a temperature between about 250° C. and about 370° C. after casting and then hot-worked.

The additional annealing step can improve final properties of the aluminum alloy composition by precipitating non-soluble very fine particles from the composition. By precipitating the non-soluble particles from the composition, a more homogeneous deformation can be provided. In addition, the precipitation of the non-soluble particles can prevent grain growth during hot-working, and inhibit grain growth during the solution annealing process. Smaller grain size provides higher volume fraction of grain boundaries that strengthen the aluminum alloy composition. For example, scandium, zirconium and hafnium are typically in the form of coherent $Al_3$(Sc,Zr,Hf) particles. If a slow cooling rate in the temperature range of about 400° C. to about 300° C. is controlled, or during annealing in the temperature range between about 250° to about 370° C., as described above, the scandium, zirconium, and hafnium may precipitate from the solid solution of the composition during casting. It is to be appreciated that if the scandium, zirconium and hafhium are already in the $Al_3$(Sc, Zr, Hf) precipitation phase after casting, the additional annealing step may be eliminated.

The high amount of grain refining elements, such as scandium, zirconium, hafnium, titanium, vanadium, chromium, and manganese, in the aluminum alloy composition of the present invention and the relatively high cooling rate during casting provides a fine homogeneous microstructure. Therefore, eliminating the need for homogenization annealing. By avoiding the homogenization annealing after casting, most of these elements in a supersaturated solid solution are retained or in a form of very fine precipitates, and after low-temperature annealing higher number density of fine reinforcing particles is present in the alloy composition leading to superior mechanical properties.

While not being bound to one particular theory, it is believed that an increase in the amount of zinc provides an increase in strength. The presence of Scandium as an alloying element can allow zinc amount to be increased up to 12 wt. % without degrading the fracture-related properties. An increased amount of manganese can increase strength in addition to the effect from zinc by formation of finely precipitated intennetallic phase. Manganese can remain in supersaturated solid solution when cast with high cooling rate, for example, chill cast. Manganese also can increase the recrystallization temperature, slows recovery and prevents grain growth. Manganese also can correct the shape of acicular iron- and silicon-based particles and decreases their embrittling effect. Scandium, zirconium and hafnium are effective grain refining elements. By producing fine $Al_3$(Sc, Zr, Hf) particles these elements can increase strength, increase recrystallization temperature, prevent grain growth and improve fracture related properties. Cerium, titanium, vanadium and chromium are grain refining elements. These elements also can prevent cracking during hot working. A small addition of nickel can improve corrosion resistance, and an addition of silver increases strength and can improve stres-scorrosion resistance of 7XXX series alloys.

The aluminum alloy composition of the present invention can be used in many applications, such as aerospace, ground transportation structures, and cryogenic applications. Aerospace structures are structures that fly and their component. The aerospace structures, including their components, operate at ambient and low temperatures, including cryogenic temperatures. Such aerospace structures and components include upper wing skins, lower wing skins, seat tracks, fuselage skins, propellers, fuselage frames, stingers, floor beams, cargo tracks, leading edges, avionic equipment mountings and cases, barrel panels, inner tank structures, isogrid structures, integrally stiffened extruded barrel panels for an aircraft, launch vehicles, cryogenic liquid engine components, such as cryogenic liquid tanks, pipes, pumps and their components.

The aluminum alloy of the present invention can be used in ground transportation structures. Ground transportation structures are structures, including their components, that are used on the ground to facilitate transportation of people, objects, and the like. The ground transportation structures include but are not limited to bumpers, sheet products, connecting rods, armor plate, people movers, suspension parts and mounting brackets and their details, liquid and cryogenic liquid transportation tanks, pipes, pumps and their components. Sheet products include but are not limited to body panels, hoods, doors, and inner panels. People movers include but are not limited to shuttles and monorails.

The aluminum alloy of the present invention can be used in cryogenic structures. Cryogenic structures are structures, including their components, that maintain their structural integrity at cryogenic temperatures. Cryogenic structures include but are not limited to cryogenic liquid tanks, pipes, pumps, and their components. In the context of handling a cryogenic fluid, cryogenic components include, but are not limited to, any components in contact with the fluid itself or that drive fluid handling components that contact the fluid, and any components that are part of the structure that are maintained at low temperatures, such as cryogenic temperatures. More specifically, cryogenic components include but are not limited to impellers, shafts, rotors, injectors, and housings. For example, referring to FIG. 1 a cryogenic pump 20 is shown. The pump 20 includes a housing 22 and a channel 24 extending through the entirety of the pump 20. Within the channel 24 are various components that either come into contact with the cryogenic fluid or drive fluid contacting components of the pump 20. One such component is an impeller 26 which is affixed to a structure lying within the channel. Another such component is an inducer 28, which drives the impeller 26.

The present invention will be further explained by way of examples, it is to be appreciated that the present invention is not limited by the examples.

EXAMPLE 1

Four aluminum alloy compositions, shown in Table 1, were created from a 7050 aluminum alloy base material. The alloy compositions were made by Wagstaff Inc. of Spokane, Wash. who provided a continuous alloy casting wherein about 400 pounds of an Al-7Zn-2Mg-1.6Cu-0.25Mn-0.18Zr (in wt. %) alloy was melted and about 120 pounds of the alloy was cast continuously in a 3" diameter rod, alloy no. 1.

Figure 2A:
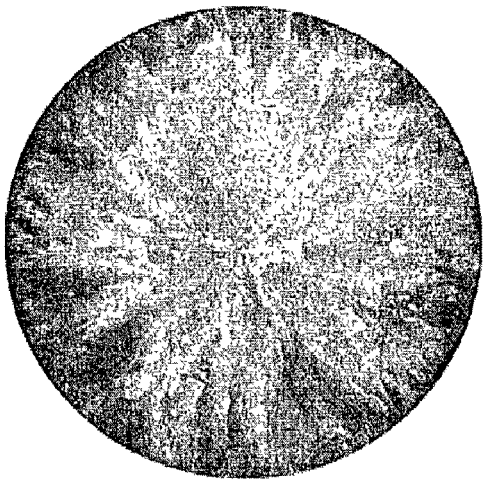
FIG. 2*a* is a photo-macrographs of transverse cross-sections of a continuously cast billet of proposed alloy compositions containing 0% Sc.
Figure 2B:
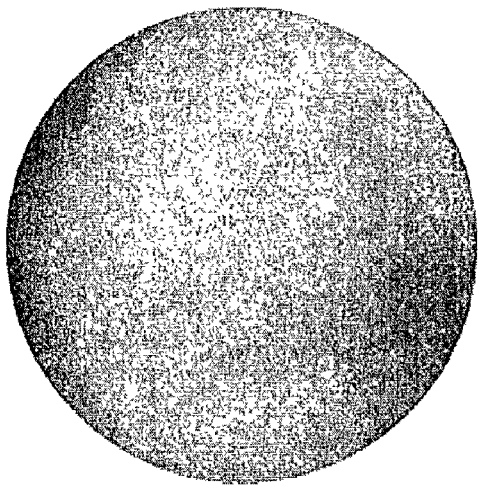
FIG. 2*b* is a photo-macrographs of transverse cross-sections of a continuously cast billet of proposed alloy compositions containing 0.38% Sc.
Figure 3:
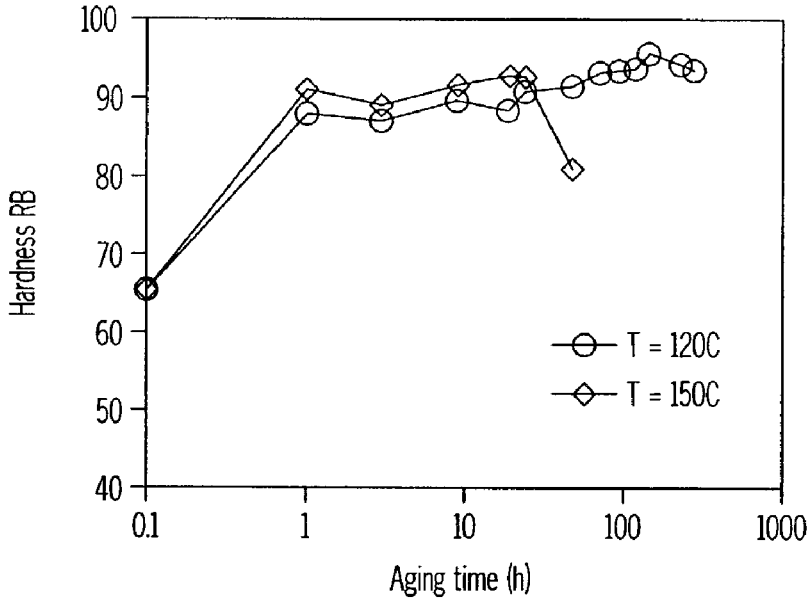
FIGS. 3–6 are graphs showing the hardness vs. the aging of an alloy composition according to the present invention.
Figure 4:
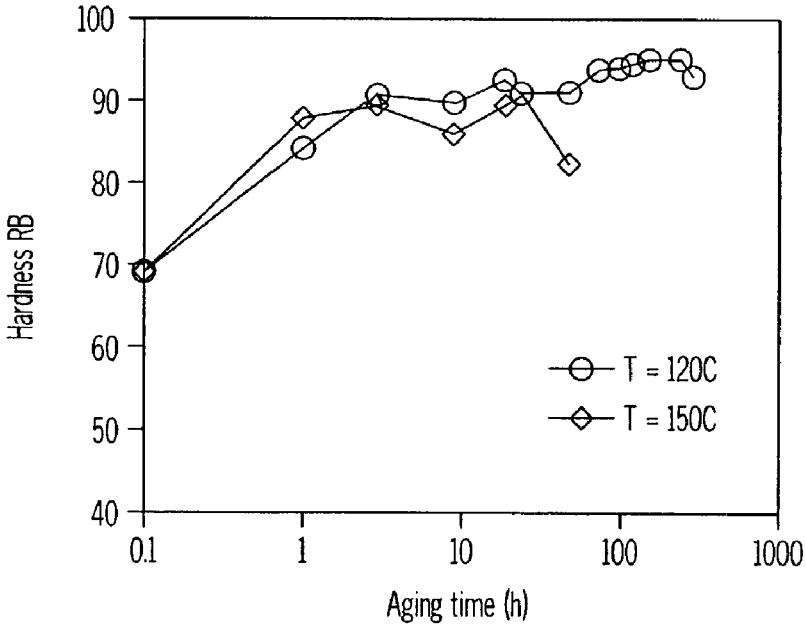
Figure 5:
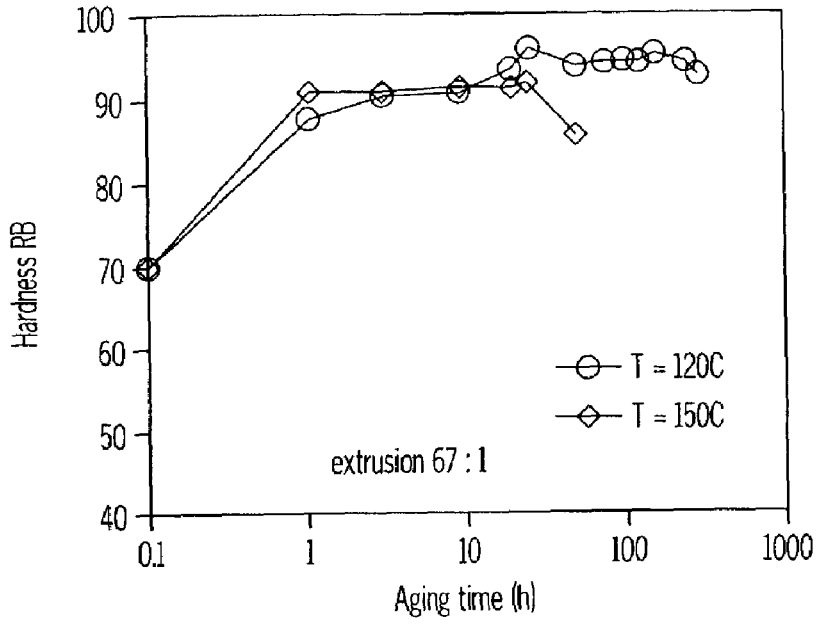

In order to add Sc to the alloy, an Al-2wt. % Sc master alloy was initially prepared by Arris International of West Bloomfield, Mich. After casting alloy no. 1, Al-2% Sc master alloy was added to the molten bath with other alloying elements to achieve the composition of alloy no. 2 in Table 1. About 120 pounds of alloy no. 2 is cast continuously into a 3" diameter rod. This procedure was repeated to produce alloy nos. 3 and 4 in Table 1. The casting speed was 7.5 inch/minute and the billet were water cooled during solidification. As shown in FIGS. 2*a* and 2*b*, an addition of scandium to the alloy led to homogeneous microstructure of casting with the grain size decreased from several centimeters to less than 1 μm. FIG. 2*a* shows an aluminum alloy composition having 0% scandium. FIG. 2*b* shows an aluminum composition having 0.38% scandium.

Next, 6" long pieces were cut from cast billets of the alloy composition. The piece was extruded at 400° C. with an extrusion ratio of 18:1 to a diameter of 0.75". Flat tensile specimens of about 0.1" thick with a gauge width of 0.14" and gauge length of 0.75" were cut from the extruded rods using an electrical discharge machine. The extrusion was conducted at 400° C. with an extrusion rate of 25.4 mm/min.

The alloy compositions were annealed at 460° C. or 500° C. for one hour and then water quenched. The alloy compositions were then aged at 120° C. or 150° C. The heat treatment conditions, hardness (HRB), yield strength (YS), ultimate tensile strength (UTS) and elongation of specific wrought alloy specimens at −196° C. are summarized in Table 2. The heat treatment conditions HRB, YS, UTS, and elongation of specific wrought alloy specimens at room temperature are summarized in Table 3.

TABLE 1

| | Element (wt. %) | | | | | | | |
|---|---|---|---|---|---|---|---|---|
| Alloy | Zn | Mg | Cu | Mn | Zr | Sc | Fe | Si |
| # 1 | 7.14 | 2.30 | 1.61 | 0.27 | 0.17 | — | 0.12 | 0.09 |
| # 2 | 7.17 | 2.2 | 1.58 | 0.30 | 0.18 | 0.18 | 0.13 | 0.088 |
| # 3 | 7.11 | 2.14 | 1.56 | 0.25 | 0.17 | 0.38 | 0.094 | 0.088 |
| # 4 | 7.05 | 2.35 | 1.55 | 0.27 | 0.14 | 0.49 | 0.095 | 0.082 |

TABLE 2

Heat Treatment Conditions and Resultant Tensile Properties of Wrought Alloys at −196° C.

| Alloy No. | Annealing T [° C.] | Aging T [° C.]/ Time [h] | HRB | YS [MPa] | UTS [MPa] | Elongation [%] |
|---|---|---|---|---|---|---|
| 1 | 460 | 120/9 | 90.0 | 860 ± 15 | 885 ± 15 | 8.5 ± 2.0 |
| | 460 | 120/19 | 91.2 | 870 ± 15 | 890 ± 15 | 9.0 ± 2.0 |
| 2 | 460 | 120/9 | 90.7 | 870 ± 15 | 890 ± 15 | 8.5 ± 2.0 |
| | 460 | 120/19 | 94.3 | 885 ± 15 | 905 ± 15 | 9.0 ± 2.0 |
| | 460 | 120+/146+ 473/0.5 | 90.3 | 770 ± 15 | 803 ± 15 | 7.0 ± 1.0 |
| | 500 | 120/24 | 93.0 | 898 ± 15 | 914 ± 15 | 10.0 ± 1.5 |
| | 500 | 120/46 | 91.5 | 920 ± 15 | 931 ± 15 | 6.5 ± 1.0 |
| | 500 | 150/6 | 92.9 | 885 ± 15 | 902 ± 15 | 7.5 ± 1.0 |
| | 500 | 150/12 | 92.8 | 875 ± 15 | 889 ± 15 | 9.2 ± 1.5 |
| 3 | 460 | 120/9 | 92.8 | 880 ± 15 | 895 ± 15 | 9.5 ± 2.0 |
| | 460 | 120/19 | 93.3 | 902 ± 15 | 911 ± 15 | 8.0 ± 1.5 |
| | 460 | 120+/146+ 473/0.5 | 90.0 | 775 ± 15 | 811 ± 15 | 8.5 ± 1.5 |
| | 500 | 150/6 | 92.0 | 864 ± 15 | 875 ± 15 | 9.0 ± 2.0 |
| 4 | 460 | 120/9 | 93.0 | 875 ± 15 | 892 ± 15 | 6.0 ± 1.0 |
| | 500 | 150/6 | 92.2 | 874 ± 15 | 884 ± 15 | 6.0 ± 1.0 |

TABLE 3

Heat Treatment Conditions and Resultant Tensile Properties of Wrought alloys at 25° C.

| Alloy No. | Annealing T [° C.] | Aging T [° C.]/ time[h] | YS [MPa] | UTS [MPa] | Elongation [%] |
|---|---|---|---|---|---|
| 1 | 460 | 120/19 | 620 ± 10 | 687 ± 10 | 12 ± 2 |
| 2 | 460 | 120/19 | 665 ± 10 | 700 ± 10 | 15 ± 2 |
| | 500 | 150/6 | 663 ± 10 | 700 ± 10 | 12 ± 2 |
| 3 | 500 | 150/6 | 643 ± 10 | 680 ± 10 | 10 ± 2 |

Figure 6:
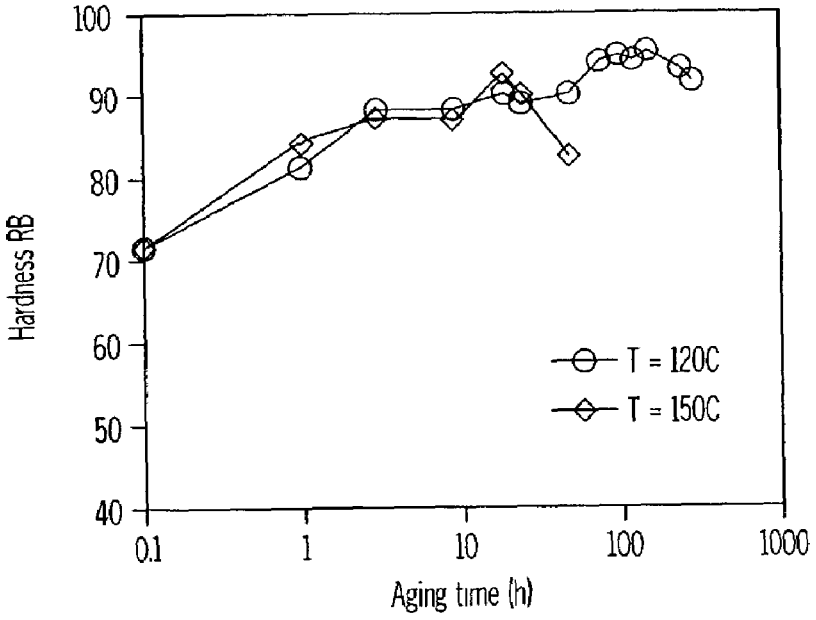
Figure 7:
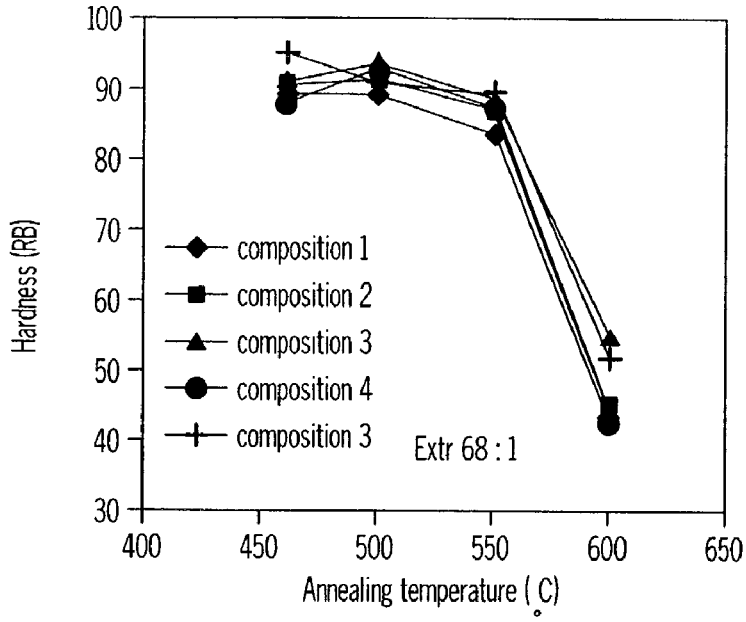
FIGS. 7–10 are graphs showing the effect of solutionizing temperature on Rockwell Hardness of alloys according to the present invention under various aging conditions.

FIGS. 3–6, illustrate the hardness vs. the aging for the alloys of 2, 3, and 4, respectively. Alloy composition 3 is shown in FIGS. 6 and 7 under different aging conditions. The alloys are solution annealed at 460° C. for 1 hour, water quenched, and aged at 120° C. or 150° C. The alloy compositions in FIGS. 3, 4, and 6 were extruded at a ratio of 18:1 and the alloy composition 3 of FIG. 5 was extruded at a ratio of 67:1. The figures show that aging at 120° C. provided a continuous increase in hardness up to 146 hours of the aging time in the alloy compositions with the extrusion ratio of 18:1 and up to 24 hours in alloy composition 3 with an extrusion ratio of 67:1. An increase in the aging temperature to 150° C. accelerated the aging and the peak harness is attainable around 19–24 hours of aging. In alloy composition 3 that was extruded with the ratio of 67:1, the maximum hardness was achieved in about 1-hour aging and then remained unchanged in the range of 1 to 24 hours. Aging times less than 19 hours at 150° C. provide hardness of that was the same or even higher than the hardness of the alloy compositions aged at 120° C.

Figure 8:
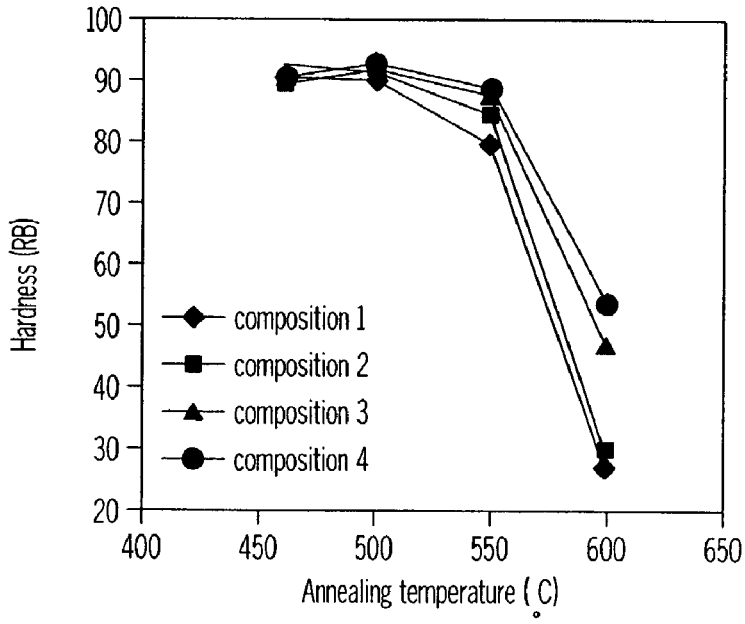
Figure 9:
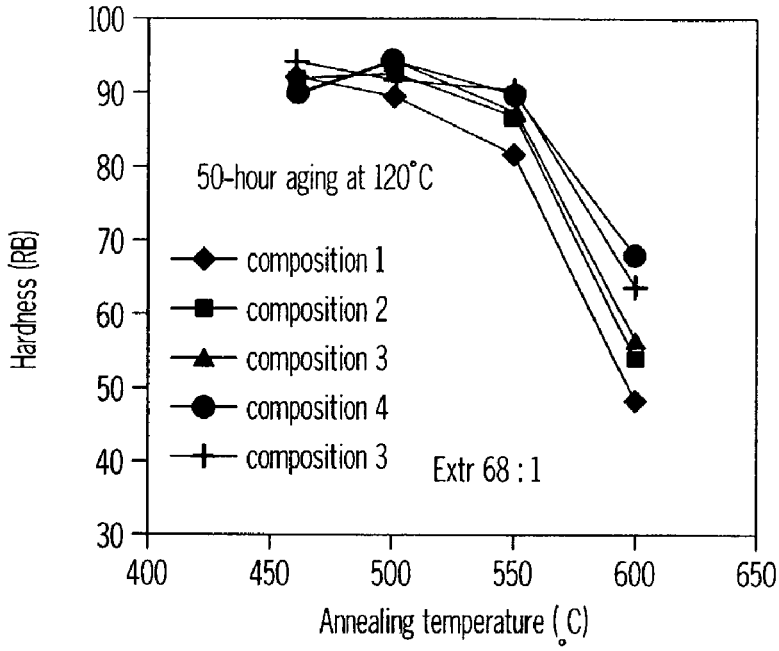
Figure 10:
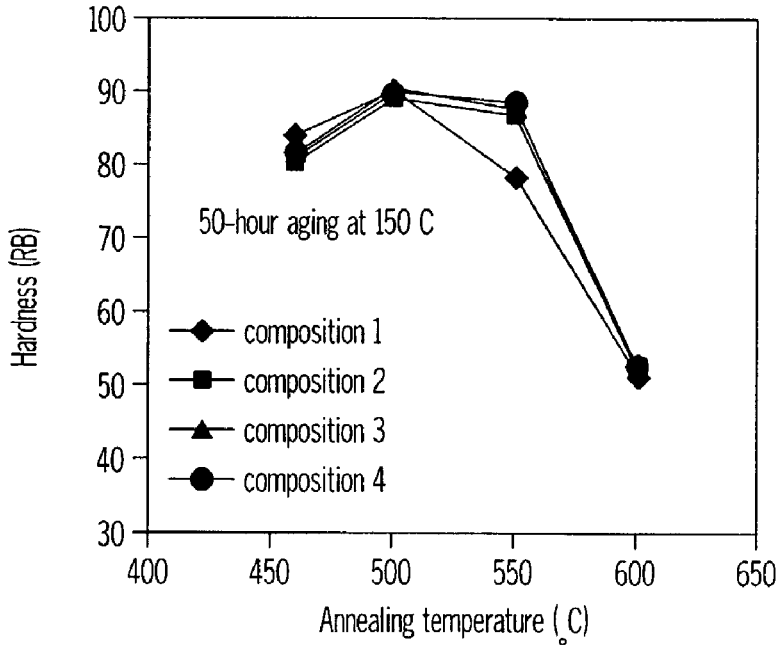

FIGS. 7 and 8 illustrate the effect of solutionizing temperature on Rockwell Hardness of the alloys after 24-hour aging at 120° C. and 150° C., respectively. FIGS. 9 and 10 illustrate the effect of solutionizing temperature on Rockwell Hardness of the alloys after 50-hour aging at 120° C. and 150° C. The hardness of the alloy compositions after 24-hour aging show maximum values when the annealing is conducted at 460° C. or 500° C.

These Figures show graphically the results in Table 2. The results indicate that elongation is very sensitive to heat treatment, at almost the same levels of strength, ductility can vary greatly.

EXAMPLE 2

Two alloys (nos. 5 and 6) were produced by Institute for Problems of Materials Science, the chemical compositions in Table 4. Alloy nos. 5 and 6 have an increased concentration of Zn and 0.49% wt. of Sc. The alloys were melted in graphite crucible at a temperature of about 800–850° C. using an induction furnace and thecast in a water-cooled copper mold of 2.2" in diameter and 5" height. The cooling rate of the casting is about $10^2$ K/s.

An extrusion is conducted at 400° C. with an extrusion rate of 25.4 mm/min and extrusion ration of 18:1. The alloy compositions were annealed, at 550° C. or 600° C. for one hour and then water quenched. The alloy compositions are then aged at 120° C. for 24 hours and overaged at 150° C. or 200° C.

TABLE 4

| | Element (wt. %) | | | | | |
|---|---|---|---|---|---|---|
| Alloy | Zn | Mg | Cu | Mn | Zr | Sc |
| # 5 | 10.3 | 2.7 | 1.3 | 0.38 | 0.15 | 0.49 |
| # 6 | 12.0 | 3.3 | 1.2 | 0.38 | 0.13 | 0.49 |

TABLE 5

| Alloy No. | Annealing T [° C.]/ Time [h] | Aging T [° C.]/ Time [h] | YS [MPa] | UTS [MPa] | Elongation [%] |
|---|---|---|---|---|---|
| | Heat Treatment Conditions and Resultant Tensile Strength Properties at −196° C. | | | | |
| 5 | 460/1 | 120/24 | 1010 | 1017 | 1.0 |
| 5 | 460/1 | 120/24 + 200/0.5 | 770 | 805 | 9.0 |
| 6 | 460/1 | 120/24 | 1063 | 1068 | 1.0 |
| 6 | 460/1 | 120/24 + 150/6 | 850 | 870 | 2.5 |
| 6 | 460/1 | 120/24 + 200/0.5 | 805 | 833 | 8.5 |

TABLE 6

| Alloy No. | Annealing T [° C.]/ Time [h] | Aging T [° C.]/ Time [h] | E [GPa] | YS [MPa] | UTS [MPa] | Elongation [%] |
|---|---|---|---|---|---|---|
| | Heat Treatment Condition and Resultant Tensile Strength Properties at 25° C. | | | | | |
| 5 | 460/1 | 120/24 | 67.3 | 766 | 781 | 7.0 |
| 6 | 460/1 | 120/24 | 69.2 | 806 | 809 | 2.5 |
| 6 | 460/1 | 120/24 + 200/0.5 | 69.5 | 560 | 575 | 8.0 |

Alloy composition 5 has an elastic modulus (E) of 67.3 GPa, YS of 766 Mpa, UTS of 781 MPa, and elongation of 7.0% at room temperature and YS of 1013 MPa, UTS of 1017 MPa, after heat treatment to a maximum hardness. Additional overaging at 200° C. for 30 minutes led to the tensile strength of 805 MPa and elongation of 9.0% at the cryogenic temperature. Alloy composition 6 after aging to a maximum hardness had YS of 1063 MPa, UTS of 1068 MPa at cryogenic temperature and after additional annealing at 200° C. for 30 minutes shows an elongation of 8.5% and a YS of 805 MPa and an UTS of 833 MPa at cryogenic temperature.

Having described the invention in detail and by reference to preferred embodiments thereof, it will be apparent that modifications and variations are possible without departing from the scope of the invention defined in the appended claims. More specifically, although some aspects of the present invention are identified herein as preferred or particularly advantageous, it is contemplated that the present invention is not necessarily limited to these preferred aspects of the invention.

What is claimed is:

1. A method for fabricating an aluminum alloy composition comprising:

selecting an aluminum alloy composition;

melting said aluminum alloy composition;

casting said aluminum alloy, said casting characterized by a cooling rate of at least about 40° C./sec;

annealing said cast aluminum alloy at a first annealing temperature at a temperature between about 250° C. to about 370° C. without prior homogenization of said cast aluminum alloy, so as to precipitate non-soluble scandium particles from said alloy compositions in the form of coherent $Al_3$ Sc particles in order to inhibit grain growth and recrystallization during annealing at a second annealing temperature;

annealing said aluminum alloy at said second annealing temperature between about 430° to about 515° C. after annealing at said first annealing temperature;

quenching said aluminum alloy after annealing said aluminum alloy at said second annealing temperature; and aging said annealed aluminum alloy, wherein said aluminum alloy composition is selected from a composition comprising between about 6.0% to about 12.0% by wt. of zinc, between about 2.0% to about 3.5% by wt. of magnesium, between about 0.5% to about 3.0% by wt. of copper, between about 0.10% to about 0.45% by wt. of manganese, between about 0.05% to about 0.20% by wt. of zirconium, between about 0.1% to about 0.5% by wt. of scandium between about 0.02% to about 0.35% by wt. of iron, between about 0.02% to about 2.0% by wt. of silicon between about 0.00% to about 0.05% by wt. of titanium between about 0.00% to about 0.25% by wt. of chromium between about 0.00% to about 0.05% by wt. of vanadium between about 0.00% to about 0.05% by wt. of hafflium between about 0.00% to about 0.20% by wt. of cerium between about 0.00% to about 0.20% by wt. of silver, and aluminum.

2. A method as claimed in claim 1, wherein said annealing at said first annealing temperature occurs for an amount of time between about 0.5 hours and about 6 hours.

3. A method as claimed in claim 1, wherein said annealing at said first annealing temperature is characterized by a duration sufficient to cause scandium, hafnium, and zirconium to precipitate as from coherent $Al_3$ (Sc, Hf, Zr) particles.

4. A method as claimed in claim 1, wherein said annealing at said second annealing temperature occurs at a temperature between about 460° C. and about 480° C.

5. A method as claimed in claim 1, wherein said aluminum alloy composition is provided, annealed, and aged so as to produce an aluminum alloy composition having a tensile strength of at least 650 MPa at an elongation of at least 7% at room temperature.

6. A method as claimed in claim 1, wherein said aluminum alloy composition is provided, annealed, and aged so as to produce an aluminum alloy composition having a tensile strength of at least 790 MPa at an elongation of at least 6% at a cryogenic temperature.

7. A method as claimed in claim 6, wherein said cryogenic temperature is about the temperature of liquid nitrogen.

8. A method as claimed in claim 6, wherein said cryogenic temperature is about −196° C.

9. A method as claimed in claim 1, wherein said aluminum alloy composition is provided, annealed, and aged so as to produce an aluminum alloy composition having a tensile strength of at least 900 MPa at room temperature.

10. A method as claimed in claim 1, wherein said aluminum alloy composition is provided, annealed, and aged so as to produce an aluminum alloy composition having a tensile strength of at least 900 MPa at a cryogenic temperature.

11. A method as claimed in claim 10, wherein said cryogenic temperature is about the temperature of liquid nitrogen.

12. A method as claimed in claim 10, wherein said cryogenic temperature is about −196° C.

13. A method of making an aluminum alloy composition, said method comprising:

providing an aluminum alloy composition, casting said aluminum alloy composition;

annealing said cast aluminum alloy composition at a first annealing temperature at a temperature between about 250° C. to about 370° C. without prior homogenization of said cast aluminum alloy composition, so as to precipitate non-soluble scandium particles from said alloy compositions in the form of coherent $Al_3Sc$ particles in order to inhibit growth and recrystallization during hot working and during annealing at a second annealing temperature;

hot working said aluminum alloy composition after annealing said aluminum alloy composition at said first annealing temperature;

annealing said aluminum alloy composition at a second annealing temperature different than said first annealing temperature alter hot working said aluminum alloy composition; and aging said annealed aluminum alloy composition wherein said aluminum alloy composition is selected from a composition comprising
about 7.17% by wt. of zinc,
about 2.2% by wt. of magnesium,
about 1.58% by wt. of copper,
about 0.30 by wt. of manganese,
about 0.18% by wt. of zirconium,
about 0.18% by wt. of scandium,
about 0.13% by wt. of iron,
about 0.088% by wt. of silicon, and aluminum, a composition comprising
about 7.11% by wt. of zinc,
about 2.14% by wt. of magnesium,
about 1.56% by wt. of copper.
about 0.25% by wt. of manganese,
about 0.17% by wt. of zirconium,
about 0.38% by wt. of scandium.
about 0.094% by wt. of iron,
about 0.088% by wt. of silicon, and aluminum, a composition comprising
about 7.05% by wt. of zinc,
about 2.35% by wt. of magnesium.
about 1.55% by wt. of copper,
about 0.27% by wt. of manganese,
about 0.14% by wt. of zirconium,
about 0.49% by wt. of scandium,
about 0.095% by wt. of iron,
about 0.082% by wt. of silicon, and aluminum, a composition comprising
about 10.3 by wt. % of zinc,
about 2.7 by wt. % of magnesium,
about 1.3 by wt. % of copper,
about 0.38 by wt. % of manganese,
about 0.15 by wt. % of zirconium,
about 0.49 by wt. % of scandium, and aluminum, a composition comprising
about 12.0 by wt. % of zinc,
about 3.3 by wt. % of manganese,
about 1.2 by wt. % of copper,
about 0.38 by wt. % of manganese,
about 0.13 by wt. % of zirconium,
about 0.49 by wt. % of scandium, aluminum, a composition compnsmg
about 9.0% by wt. zinc,
about 3.0% by wt. magnesium,
about 2.6% by wt. copper,
about 0.1% by wt. chromium,
about 0.2% by wt. cerium,
about 0.20% by wt. nickel,
about 0.1% by wt. vanadium,
about 0.2% by wt. zirconium,
about 0.2% by wt. scandium,
about 0.12% by wt. iron,
about 0.09% by wt. silicon, and aluminum, a composition comprising
about 8.9% by wt. zinc.
about 2.7% by wt. magnesium,
about 2.4% by wt. copper,
about 0.2% by wt. manganese,
about 0.1% by wt. hafnium,
about 0.1% by wt. zirconium,
about 0.46% by wt. scandium,
about 0.05% by wt. chromium.
about 0.16% by wt. iron,
about 0.07% by wt. silicon,
less than 0.05% by wt. nickel,
less than 0.05% by wt. titanium,
less than 0.05% by wt. vanadium, and aluminum, and a composition comprising
about 8.5% by wt. zinc,
about 2.6% by wt. magnesium,
about 2.2% by wt. copper,
about 0.2% by wt. manganese,
about 0.1% by wt. silver,
about 0.1% by wt. zirconium,
about 0.4% by wt. scandium,
about 0.15% by wt. iron,
about 0.10% by wt. silicon, and aluminum.

14. A method as claimed in claim 13, wherein said annealing said aluminum alloy composition at said first annealing temperature is characterized by an annealing temperature and duration sufficient to precipitate particles from said aluminum alloy composition that will not be dissolved during hot working and annealing at said second annealing temperature and will prevent grain growth during hot working and annealing at said second annealing temperature.

15. A method as claimed in claim 13, wherein said annealing said aluminum alloy composition at said first annealing temperature is characterized by an annealing temperature and duration sufficient to cause scandium, hafnium, and zirconium to precipitate from coherent $Al_3$ (Sc, Hf, Zr) particles.

16. A method as claimed in claim 13, wherein said method further comprises selecting alloying elements to form the aluminum alloy composition.

17. A method as claimed in claim 13, wherein said method further comprises melting alloying elements to form the aluminum alloy composition.

18. A method as claimed in claim 17, wherein said melting occurs at a temperature above 700° C.

19. A method as claimed in claim 17, wherein said melting occurs at a temperature between about 750° C. to about 800° C.

20. A method as claimed in claim 17, wherein said melting occurs at a temperature at which all alloying elements are in a liquid solution with no solid intermetallic particles.

21. A method as claimed in claim 17, wherein said melting occurs in a protective atmosphere.

22. A method as claimed in claim 13, wherein said casting provides a cooling rate that is not less than about 40° C./sec.

23. A method as claimed in claim 13, wherein said casting provides a cooling of said aluminum alloy to a temperature of about 300° C.

24. A method as claimed in claim 13, wherein said hot-working is performed at a temperature between about 350° C. to about 450° C.

25. A method as claimed in claim 13, wherein said hot-working is performed with a true strain of about 1.

26. A method as claimed in claim 13, wherein said hot-working is performed with a true strain over 1.

27. A method as claimed in claim 13, wherein said method further comprises quenching said aluminum alloy composition.

28. A method as claimed in claim 27, wherein said quenching is performed using a material selected from water or oil.

29. A method as claimed in claim 27, wherein said quenching occurs after annealing said aluminum alloy composition at said first annealing temperature.

30. A method as claimed in claim 27, wherein said quenching occurs after annealing said aluminum alloy composition at said second annealing temperature.

31. A method as claimed in claim 27, wherein said quenching is performed at a rate that prevents precipitation of particles selected from the group consisting of Zn, Mg, and Cu.

32. A method as claimed in claim 13, wherein said second annealing temperature is higher than said first annealing temperature.

33. A method as claimed in claim 13, wherein said second annealing temperature is between about 430° C. and about 500° C.

34. A method as claimed in claim 13, wherein said second annealing temperature is between about 460° C. to about 480°0 C.

35. A method as claimed in claim 13, wherein said annealing at said second annealing temperature occurs for about 1 hour.

36. A method as claimed in claim 13, wherein said aging is performed at a temperature between about 110° C. and about 160° C.

37. A method as claimed in claim 13, wherein said aging is conducted at a temperature between about 120° C. and about 150° C.

38. A method as claimed in claim 13, wherein said aging occurs for a time between about 6 hours and about 24 hours.

39. A method as claimed in claim 13, wherein said aging occurs for an amount of time between about 1 hour and about 24 hours.

40. A method as claimed in claim 13, wherein said method further comprises two-step aging said aluminum alloy composition.

41. A method as claimed in claim 40, wherein said two-step aging comprises:

aging said aluminum alloy composition at a first aging temperature; and aging said aluminum alloy composition at a second aging temperature.

42. A method as claimed in claim 40, wherein said first aging temperature is between about 110° C. and about 130°C.

43. A method as claimed in claim 40, wherein aging at said first aging temperature occurs for an amount of time between 2 hours and 48 hours.

44. A method as claimed in claim 40, wherein said second aging temperature is higher than said first aging temperature.

45. A method as claimed in claim 40, wherein said second aging temperature is up to about 160° C.

46. A method as claimed in claim 40, wherein said second aging temperature occurs for an amount of time between about 0.5 hours and 6 hours.

47. A method as claimed in claim 40, wherein said two-step aging is performed on an aluminum alloy composition having a zinc content less than 8% by wt.

48. A method as claimed in claim 47, wherein said first aging temperature is about 130° C.

49. A method as claimed in claim 47, wherein said second aging temperature is about 150° C.

50. A method as claimed in claim 47, wherein aging at said second aging temperature occurs for an amount of time between about 0.5 hours and about 6 hours.

51. A method as claimed in claim 40, wherein said two-step aging is performed on an aluminum alloy composition having a zinc content of at least 8% by wt.

52. A method as claimed in claim 51, wherein said second aging temperature is performed between about 160° C. and about 200° C.

53. A method as claimed in claim 52, wherein said aging at said second aging temperature is performed for a period of time not exceeding 1 hour.

54. A method as claimed in claim 13, wherein said aluminum alloy composition is provided, annealed, and aged so as to produce an aluminum alloy composition having a tensile strength of at least 650 MPa at an elongation of at least 7% at room temperature.

55. A method as claimed in claim 13, wherein said aluminum alloy composition is provided, annealed, and aged so as to produce an aluminum alloy composition having a tensile strength of at least 790 MPa at an elongation of at least 6% at a cryogenic temperature.

56. A method as claimed in claim 55, wherein said cryogenic temperature is about the temperature of liquid nitrogen.

57. A method as claimed in claim 55, wherein said cryogenic temperature is about −196° C.

58. A method as claimed in claim 13, wherein said aluminum alloy composition is provided, annealed, and aged so as to produce an aluminum alloy composition having a tensile strength of at least 900 MPa at a cryogenic temperature.

59. A method as claimed in claim 13, wherein said aluminum alloy composition is provided, annealed, and aged so as to produce an aluminum alloy composition having a tensile strength of at least 900 MPa at room temperature.

* * * * *

UNITED STATES PATENT AND TRADEMARK OFFICE

CERTIFICATE OF CORRECTION

PATENT NO. : 7,048,815 B2
APPLICATION NO. : 10/291201
DATED : May 23, 2006
INVENTOR(S) : Senkov et al.

It is certified that error appears in the above-identified patent and that said Letters Patent is hereby corrected as shown below:

Col. 14, Line 6, “a composition compnsmg” should read --a composition comprising--.

Signed and Sealed this

Thirty-first Day of October, 2006

JON W. DUDAS
*Director of the United States Patent and Trademark Office*